US009468955B2

(12) United States Patent
Sauer et al.

(10) Patent No.: US 9,468,955 B2
(45) Date of Patent: Oct. 18, 2016

(54) TAPPING POINT CLEARING APPARATUS

(75) Inventors: Hans Ernst Sauer, South Perth, WA (US); Carl James Pettersson, Rockingham, WA (US)

(73) Assignee: Cleargaurd IPCo Pty Ltd, West Perth (AU)

( * ) Notice: Subject to any disclaimer, the term of this patent is extended or adjusted under 35 U.S.C. 154(b) by 456 days.

(21) Appl. No.: 14/113,189

(22) PCT Filed: Mar. 14, 2012

(86) PCT No.: PCT/AU2012/000259

§ 371 (c)(1),
(2), (4) Date: Nov. 1, 2013

(87) PCT Pub. No.: WO2012/142647

PCT Pub. Date: Oct. 26, 2012

(65) Prior Publication Data

US 2014/0047651 A1 Feb. 20, 2014

(30) Foreign Application Priority Data

Apr. 21, 2011 (AU) ..... 2011901511

(51) Int. Cl.
*B08B 9/043* (2006.01)
*B08B 1/00* (2006.01)
*B08B 9/00* (2006.01)

(52) U.S. Cl.
CPC ..... *B08B 9/0436* (2013.01); *B08B 1/008* (2013.01); *B08B 9/00* (2013.01)

(58) Field of Classification Search
CPC ... A47L 9/0072; B08B 9/0436; B08B 1/008; B08B 9/00
See application file for complete search history.

(56) References Cited

U.S. PATENT DOCUMENTS 3,143,302 A * 8/1964 Carlson ..... F16L 45/00 134/8
3,631,555 A * 1/1972 Hurst ..... F41B 11/87 15/104.062
3,771,187 A 11/1973 Dillinger
4,321,096 A * 3/1982 Dobbin ..... B02C 23/04 134/18
6,363,566 B1 * 4/2002 Collins ..... B08B 9/027 137/245.5
6,865,766 B2 * 3/2005 Pettersson ..... B08B 1/008 15/104.03

FOREIGN PATENT DOCUMENTS

WO 02/036276 A1 5/2002

* cited by examiner

*Primary Examiner* — Dung Van Nguyen
(74) *Attorney, Agent, or Firm* — Charles H. Jew

(57) ABSTRACT

A process tapping point clearing apparatus (10) has a ram housing a piston (25) in a cylinder (12). A piston shaft (22) has a threaded first end (30) threadingly engaged with the piston. A second end of the shaft retains a clearing head extending from the cylinder, the clearing head adapted to pass through a process tapping point for removing scaling and/or debris material therefrom. The threaded first end of the shaft has an outer thread (36) diameter substantially the same as the diameter of the adjacent intermediate portion of the shaft. The piston can have a threaded aperture (44) to receive an release tool (45) to retract the piston and tapping point clearing toll (34) if stuck in an extended position.

30 Claims, 5 Drawing Sheets

TAPPING POINT CLEARING APPARATUS

FIELD OF THE INVENTION

The present invention relates to improvements to apparatus for clearing process tapping points in industrial and mineral processing operations. Such tapping points are generally used within process measurement systems.

BACKGROUND TO THE INVENTION

The processing industry relies upon the accurate measurement of process variables to enable efficient control of industrial processes. One of the most common methods of taking various process measurements is via process tapping points exposed to the interior contents of a process vessel or pipeline. Flow and/or pressure through an internal bore of the tapping points is indicative of certain process variables.

Such tapping points encounter progressive scaling or debris build-up over time within their internal bores. The restriction or blockage of process tapping points by scaling or debris build-up can cause inaccurate process measurement, inaccurate product sampling or even render the process measurement completely unavailable.

Therefore, when process tapping points are blocked or restricted to the point of affecting the accuracy of the process measurement, they need to be cleared.

Traditional methods used in the clearance of process tapping points include the removal of the blocking material using manual or power tools whilst the process is online. Given the toxic and/or flammable nature of most process fluids, this can be a highly hazardous operation for even the most experienced operators.

Another method used to maintain the clearance of the process tapping points is the introduction of a purge fluid through the tapping points. This purge fluid passes continuously through the tapping point, delaying the settling of scaling or debris. The disadvantage of this method is that it adds a large amount of inert media to the process fluid that must later be extracted at significant expense to maintain process efficiency. Further, the introduction of purge fluid through the tapping point does not stop the tapping point blocking, but merely delays the blocking.

Similarly, another way of slowing blockage is to provide larger diameter tapping points so that the time taken to block is longer. Large, oversize process connections have been utilised to provide for longer periods where accurate process measurements can be obtained. This arrangement merely delays the inevitable need to clear the process tapping points. Oversize process connections are also more expensive to install than conventional connections.

International application publication number WO02/36276, the contents of which are incorporated herein by reference, discloses an automated tapping point clearing apparatus. The apparatus includes a clearing tool employed on a reciprocating shaft. The clearing tool includes a scraping ring arranged to clear debris built up on an internal bore of a tapping point. The clearing tool also includes a plurality of apertures to allow fluids to flow through the clearing tool during a cleaning operation thereby maintaining accurate process variable measurement even during the passage of the clearing tool through the aperture.

Tapping point clearing apparatuses made in accordance with that international application have proved useful and reliable. Nonetheless, certain deficiencies in their use have become apparent.

In use, during an advance (clearing tool extending) or retract (clearing tool returning) stroke, the clearing tool on the end of the shaft, and the piston and its attached shaft within the cylinder of the clearing tool, are exposed to rapid acceleration and deceleration forces during extension and retraction phases. The shaft is operable by a pneumatic piston, and it is imperative that the clearing tool is advanced rapidly in order to "punch through" any potential build up of process material covering the tapping point. However, the piston (with attached shaft) within the cylinder has to be stopped rapidly at the end of the advance and retract strokes. A known arrangement for controlling the rapid deceleration forces at the end of each stroke is to provide resilient limit of travel stops, such as rubber or rubberised stops. The piston hits the limit of travel stop in either direction, thereby providing a cushioned stop for the piston.

However, despite such impact cushioning, the piston and attached shaft undergo rapid deceleration over a very short distance. This puts severe stress on the joint between the shaft and piston. Typically the shaft has a threaded piston end machined down to a reduced diameter in order to provide a shoulder at that end of the shaft on the unmachined portion. That shoulder provides a seat and thread limit against the face of the piston. The thread on the end of the shaft is received in a corresponding threaded blind aperture in the centre of the piston. Consequently, when the piston and shaft undergo rapid deceleration at full extension, the reduced diameter shaft adjacent the full diameter shoulder at the shoulder can fail. This can result in the clearing tool and at least a portion of the piston being lost into the process vessel or pipe. Understandably, such a failure can result in damage to process equipment and machinery, such as blockage of valves or pumps downstream of the failed tapping point clearing apparatus. Furthermore, the tapping point clearing apparatus has to be repaired or replaced. Either way, the process may be shut down until such time as the clearing apparatus is repaired and the lost shaft recovered. This results in economically expensive downtime for the process plant as well as risk to personnel having to recover the lost shaft from a toxic, extremely hot or corrosive process stream.

A further deficiency in the operation of the apparatus of WO02/36276 becomes when providing an external visual indication as to the position of the clearing tool, in order to identify errors in operation of the tapping point clearing apparatus. A known previous apparatus achieved this by use of a clear plastic tube fixed to the external surface of the ram and containing coloured magnets that travelled the full length of the clear tube directly adjacent to a magnet fixed to the piston inside the ram. This visual indication was found to work effectively only in installations where the complete unit could be installed horizontally. In vertical or inclined installations gravity prevented continual position indication as the coloured magnet inside the clear tube would not reliably slide upwards. As it got covered in dust, we then could not see the orange magnet, as it got older the friction inside the clear plastic tube meant that sometimes the orange magnet sticks or does not follow the magnet attached to the piston because of ingress of residue or dirt into the tube. Also, the clear tube housing the coloured magnet would discolour over time, rendering the moving magnet even more difficult to observe even if it did move.

The present invention has been created in light of these practical deficiencies in the operation of the prior art.

Although described with reference to process industry it would be clear to a person skilled in the art that the present invention has applicability to a number of industries where access is required to a pipe or vessel that scales during use.

SUMMARY OF THE INVENTION

With this in mind, there is provided a process tapping point clearing apparatus including:

- a ram housing a piston in a cylinder, the piston dividing the cylinder into first and second internal chambers,
- a shaft having a threaded first end adjacent an unthreaded intermediate portion of the shaft, the threaded first end threadingly engaged with a corresponding threaded portion of the piston,
- a second end of the shaft retaining a clearing head extending from the cylinder, the clearing head adapted to pass through a process tapping point for removing scaling and/or debris material there from; and
- wherein the threaded first end of the shaft has a outer thread diameter substantially the same as the diameter of the adjacent intermediate portion of the shaft.

Thus, with the threaded end of the shaft being substantially the same diameter as that of the adjacent shaft, the connection between the shaft and piston is made stronger and less likely to fail under rapid deceleration at the advance and retract stop limits, particularly the advance (extending the clearing head) movement.

The thread of the threaded first end of the shaft may extend to meet the shafts outer surface at the adjacent intermediate portion, thereby ensuring maximum connection between the threaded first end and remaining shaft. This arrangement avoids thinning the diameter of the shaft between the shoulder formed by the unthreaded intermediate portion of the shaft and the start of the thread at the threaded first end. Prior art arrangements are known to fail at this weakened point.

The piston may include a through aperture arranged to receive a retaining fastener, the retaining fastener configured to engage with the threaded first end of the shaft within the piston and thereby prevent unthreading of the shaft from the piston until the retaining fastener is released from engagement with the threaded first end of the shaft. The retaining fastener may be threaded, such as in the form of a 'grub' screw.

The through aperture may extend from an outer piston side surface adjacent an internal side wall of the cylinder to a threaded aperture extending into the piston from a first piston face adjacent the shaft, the threaded aperture arranged to receive the threaded first end of the shaft. Alternatively, or in addition, the through aperture may extend from a portion of the piston open to a second face of the piston, whereby the retaining fastener extends through an internal central portion of the piston into a threaded aperture extending into, and preferably coaxial with, a centre axis of the shaft.

The retaining fastener may be a grub screw, such as a 2.0 mm Ø threaded screw with recesses drive portion.

Thus, the threaded first end of the shaft, and thus the shaft, may be 'keyed' by the retaining fastener to prevent the shaft rotating and the cooperating shaft and piston threads separating. The grub screw can thus provide such a key.

The shaft may have an outer diameter of 10.0 mm, 12.0 mm, 16.0 mm or 20.0 mm. Consequently, the threaded first end of the shaft may have substantially the same matching diameter of 10.0 mm, 12.0 mm 16.0 mm or 20.0 mm.

The piston and therefore the shaft may be driven for reciprocal motion by alternatively supplying and extracting fluid to and from the first and second chambers i.e. a double acting ram. This results in the shaft and the piston moving in a reciprocal manner. This therefore enables the cleaning head located at the end of the shaft to be driven in a reciprocal manner.

Actuation means may utilise compressed air to drive the piston pneumatically. It is to be appreciated that alternative actuation means are envisaged. For example the actuation means may alternatively be provided by hydraulic fluid or may be driven by an electrically actuated means.

wherein the indicating means is attracted to a location on the shaft by remote means such that movement of the shaft location during reciprocating action of the shaft causes movement of the indicating means within the viewing portion. Advantageously, this provides a compact means of displaying the position of the shaft to an observer. Preferably the remote means employs magnetic attraction.

The ram may also accommodate a manual retraction means to retract the advanced piston and shaft, and thus the clearing head from the process tapping point. This may be necessary, for example, where there has been a malfunction in the power supply or the compressed air/hydraulic supply system, or where the clearing head is jammed within the tapping point, or if the piston or shaft becomes jammed during its travel or at the end stop after advancing. The piston may have provision to receive a removably connectable retraction tool, which, in use, is attached to piston to extend from an opposing side of the piston to that of the shaft supporting the clearing head. The retraction tool may include a second shaft to be releasably engaged with the piston via an aperture into the second face of the piston. The retraction tool may therefore be attached or integral to the second shaft to enable the tool to pull on the piston and extract the clearing head from the process tapping point. The aperture into the second face of the piston may be threaded to thereby releasably engage with a corresponding threaded end of the second shaft of the retraction tool. The retraction tool may include an end forming or incorporating a handle to aid rotation of the second shaft to engage the threads and thereby releasably attach/detach the tool from the piston. The handle may be a T-bar. The ram may include a sealable plug arrangement to releasably seal an aperture into the ram through which the retraction tool second shaft is inserted to engage with the piston. The plug may include a thread to engage with a thread of the aperture into the ram.

In accordance with a second aspect of the present invention there is provided a tapping point clearing apparatus including a position indication means, the clearing apparatus having a ram with an internal reciprocating piston and an associated shaft extending from the piston within a cylinder of the ram to a clearing head external of the cylinder of the ram at a distal end of the shaft, the position indication means including at least one sensor mounted externally of the cylinder, the at least one sensor arranged to detect respective advanced and retracted positions of the piston, and a position indication display means arranged to give a visual indication of detected advanced and retracted positions of the piston.

Preferably the at least one sensor may include first and second sensors arranged in spaced relationship, the first sensor arranged to detect to one of the advanced or retracted positions and the second position sensor arranged to detect the other of the advanced or retracted positions.

The visual indication for advanced and retracted positions may be the same, such as a particular coloured light (e.g. a green light).

Intermediate positions of the piston between the advanced and retracted positions may be indicated by a different indication, such as a different colour light compared to the indication of an advanced or retracted position.

Showing a positive visual indication of the fully or sufficiently advanced and retracted positions of the piston, and therefore the respective positions of the clearing head/tool demonstrates that the ram is operating within required parameters. Furthermore, a positive visual indication that the piston is at an intermediate position allows an operator to positively check operation of the ram, such that the visual indication changes from a first indication to a second indication and then back to the first indication during each of the forward (advance) and rearward (retraction) strokes.

Visual indication may be provided by a visual indication unit mounted on the ram or mounted remotely. Preferably the visual indication unit includes a test facility to cause the ram to actuate on demand rather than waiting for the next timed cycle, such as by use of a local test button/switch and controller.

The at least one sensor may be provided by one or more induction sensors. A magnet may be mounted to the piston and/or shaft within the ram and the magnetic field may be sensed by the at least one induction sensors to detect position of the piston. A sensed position is then sent to the visual indication unit to give the visual indication.

BRIEF DESCRIPTION OF THE DRAWINGS

It will be convenient to further describe the invention with reference to the accompanying drawings which illustrate preferred embodiments of the process tapping point clearing apparatus of embodiments of the present invention. Other embodiments are possible, and consequently, the particularity of the accompanying drawings is not to be understood as superseding the generality of the preceding description of the invention. In the drawings.

DESCRIPTION OF PREFERRED EMBODIMENT

Figure 1:
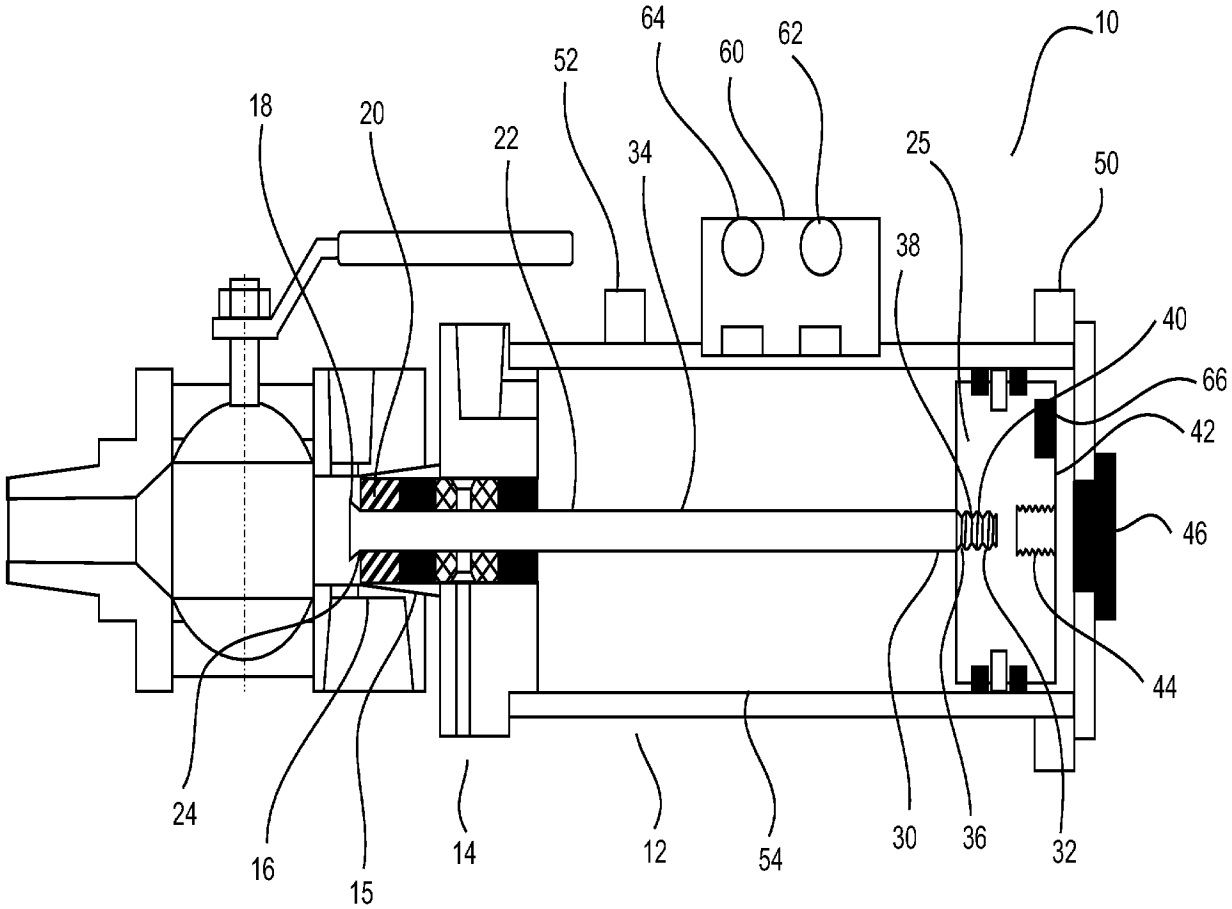
FIG. 1 is sectional side view of a process tapping point clearing apparatus in accordance with an embodiment the present invention, the piston being fully retracted.
Figure 2:
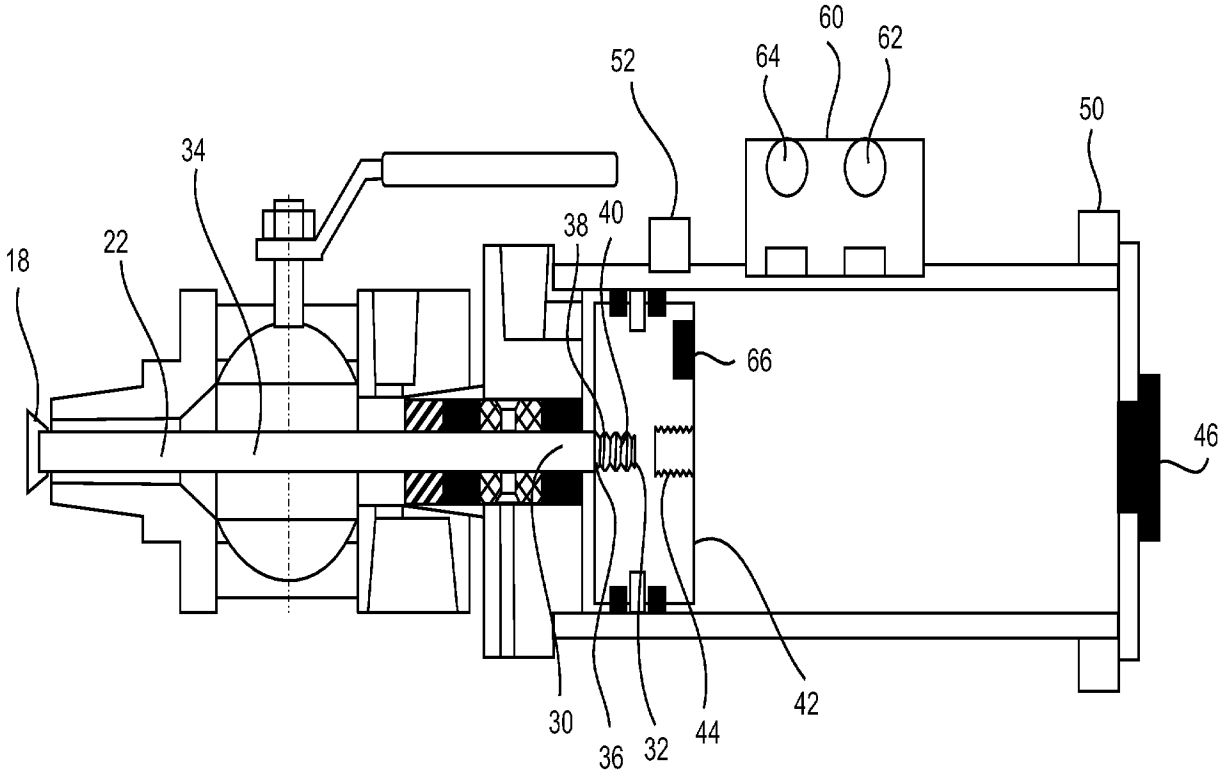
FIG. 2 is a sectional side view of a process tapping point clearing apparatus in accordance with an embodiment the present invention, the piston being fully advanced/extended.

FIG. 1 shows a process tapping point clearing apparatus 10. The apparatus 10 includes a pneumatic cylinder 12, which is axially mounted by suitable means such as a flanged connection to a head portion 14. The head portion 14 includes a housing 15 having an outer, externally threaded portion 16 arranged to engage within a tapping point (Generally behind an isolation valve in a process vessel, pipeline or similar.

A clearing tool 18 extends from a front end 20 of the housing 15. The clearing tool 18 is axially mounted to a reciprocating shaft 22. The shaft 22 extends through an aperture 24 in the front end 20 of the housing 15, through the head portion 14 and into the cylinder 12. Axial movement of the shaft 22 causes the clearing tool 18 to move through the process vessel tapping point, clearing the tapping point of accumulated debris.

The shaft 22 is mounted to a piston 25 within the cylinder 12. Supply of compressed air through a respective connection (not shown) results in axial movement of the piston within the cylinder 12, and thus reciprocating motion of the shaft 22 and clearing tool 18.

The shaft 22 has an end 30 connected to the piston of the same diameter 32 as the diameter of the shaft 34. This end has thread 36 that releasably engages with a corresponding thread 38 in a blind aperture 40 in a first face of the piston 25. This threaded end of the shaft provides for a stronger connection to the piston by avoiding the need for a reduced diameter machined end that otherwise creates a weakened connection to the piston. This threaded end 30 maintains the full diameter of material of the shaft thereby creating stronger connection and removes the otherwise weak point of the shaft prone to breakage in known devices. Removing this weak point creates a more reliable robust ram with less likelihood of down time to repair the ram or to recover or remove a clearing head and shaft from the tapping point or somewhere else downstream in the process vessel or pipe work.

Figure 5:
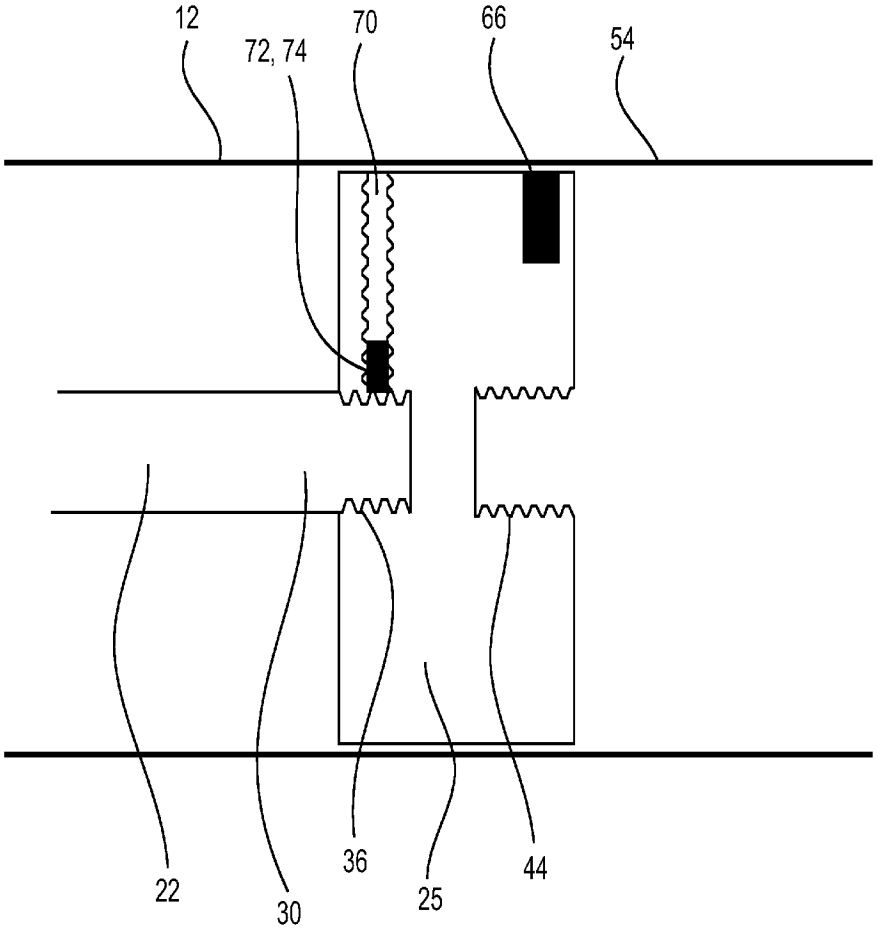
FIG. 5 shows a sectional side view of a piston and shaft connection arrangement of an embodiment of the present invention.

As shown in FIG. 5, the threaded 36 end 30 of the shaft 22 may be retained in the threaded 38 aperture 40 in the piston by a retaining means. A through aperture 70 may be provided in the piston for a retaining fastener 72 to engage with the threaded end of the shaft. This may be provided by a set or grub screw 74 tightened to impinge on the thread 36 of the shaft 22 to prevent the shaft rotating and thereby releasing from the piston.

Figure 3:
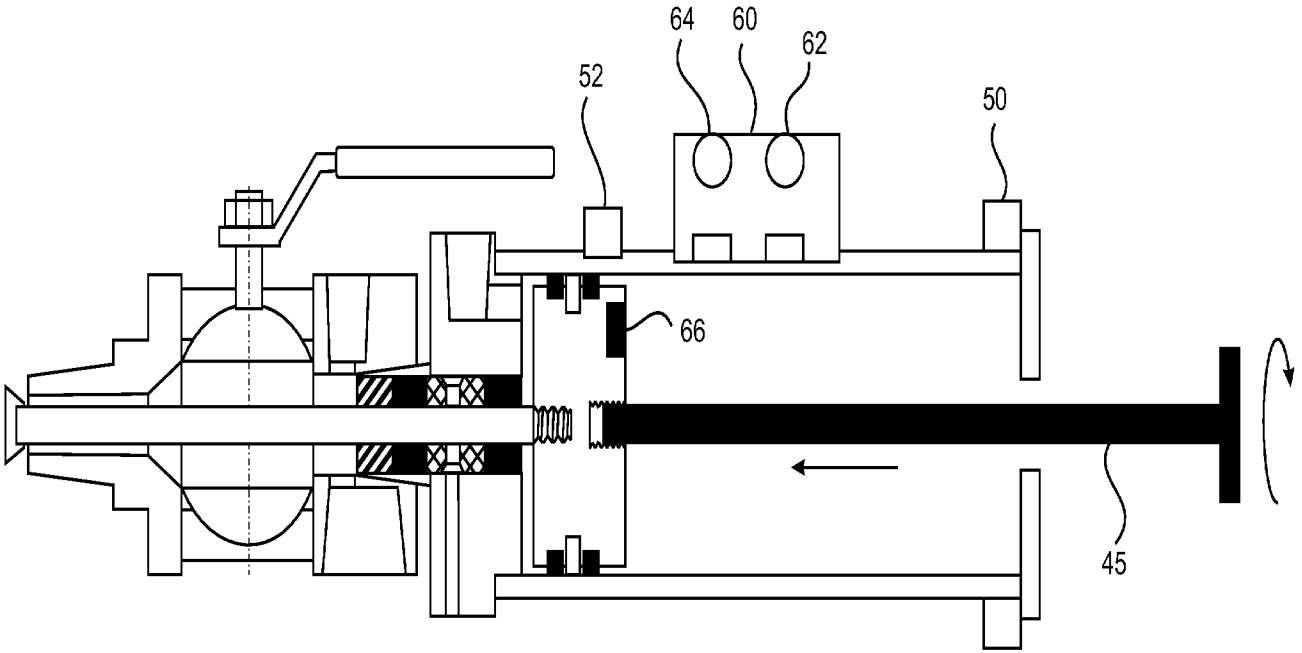
FIG. 3 is a sectional side view of a process tapping point clearing apparatus in accordance with an embodiment the present invention, the piston being fully advanced and a manual retraction tool inserted into the ram to retract the clearing head.
Figure 4:
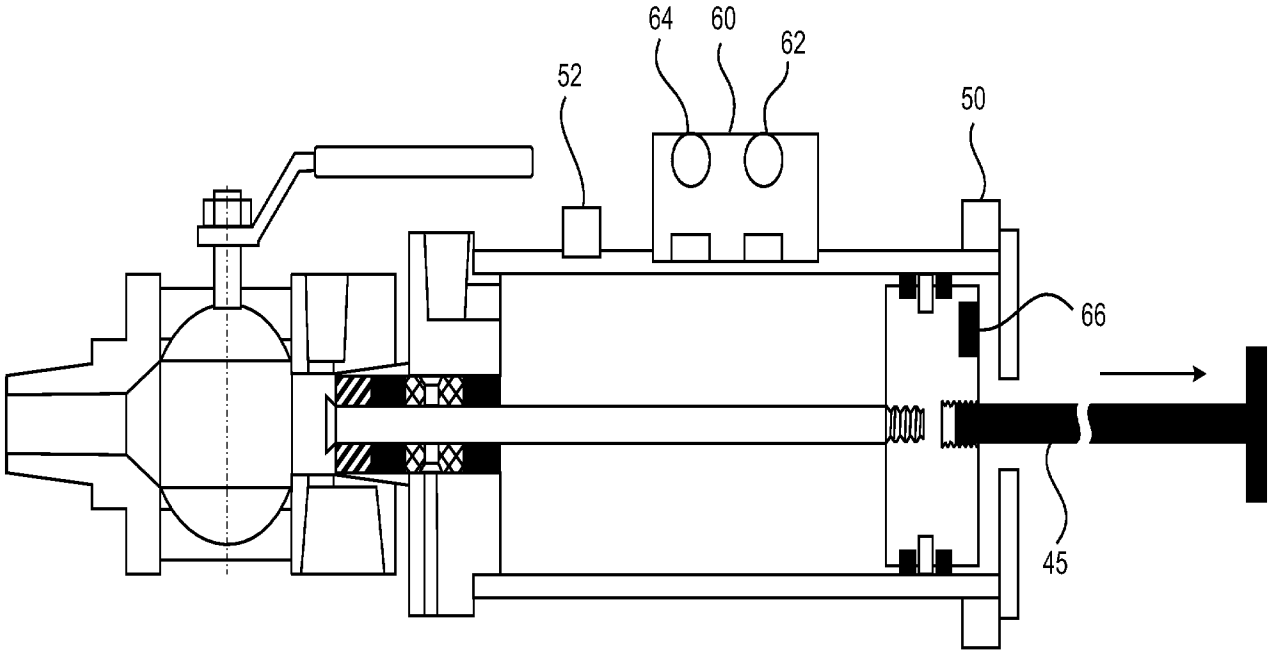
FIG. 4 shows a sectional side view of a process tapping point clearing apparatus in accordance with an embodiment the present invention, the piston being fully retracted by use of the manual retraction tool.

The second face 42 of the piston includes an aperture 44, preferably a threaded aperture, arranged to releasably receive an end of a retraction tool 45 (FIG. 3). As shown in FIGS. 3 and 4, if the piston, and therefore the shaft attached to the clearing tool, are stuck part way or fully advanced in their forward stroke, the retraction tool can be used to engage with the piston and manually retract the piston and clearing tool. This may be needed if the piston or connected shaft are jammed, such as due to contamination, or if pneumatic/hydraulic supply to the piston fails with the piston partially/fully advanced. To do so, the plug 46 is removed from the cylinder end and the retraction tool inserted. This is carried out when there is no dangerous pressure on the plug side of the piston. The plug may have a thread to engage with a corresponding thread in the end of the cylinder.

In the embodiment shown, two sensors 50,52 are mounted to the cylinder casing 54 of the cylinder 12. These detect the position of the piston 25 within the cylinder 12. The sensors provide a signal to a display unit 60 to indicate position of the piston and therefore an advanced or retracted position of the clearing head. For example, with the clearing head tool 18 retracted, the piston should be towards the plug end of the cylinder. Sensor 52 can provide an indication of correct piston position via a first visual indicator 62 on the display unit 60. If the piston is partially advanced and is therefore between the first sensor 50 and the second sensor 52, a second visual indicator 64 may indicate this. Optionally, the first visual indicator may be maintained showing an indication or may be switched off to indicate the intermediate position of the piston between the first and second sensors. The second indicator may be switched off when the piston is at full stroke within the cylinder, and if the first indicator was switched off during piston travel in the cylinder, the first indicator now turns on when the piston is at full stroke to indicate successful full stroke of the piston and therefore full advancement of the clearing tool. The first and second indicators may be used to indicate return travel of the piston and therefore successful retraction of the piston and clearing tool. The first and/or second indicators can be used to indicate that the piston is stuck between the full retraction and full advancement positions i.e. between sensors 50,52. This can indicate a fault, such as a faulty ram or low pressure supply driving the piston.

An indicating means 66 is provided on the piston. This indicating means formed may be formed of a ferromagnetic material. The sensors 50,52 inductively sense the presence of the magnetic field and signal an indication via the display unit. The magnetic field can be sensed through the material of the cylinder casing, even a metal cylinder. Such an arrangement avoids the need for apertures through the casing for provision of a moving indicator mounted on the piston or shaft. The ram is therefore more reliable and less prone to leakage. The visual indication form the display unit can be by lights, such as red and/or green lights, which may be LED lights for low power consumption. Such a display provides for high visibility, particularly when rams are in restricted access locations or close to very hot process equipment or at dangerous heights. The visual indication can be seen without needing to be very close to process tapping point ram. Furthermore, the position indication can be fed to a remote display, such as in a control room, thereby removing the need to go to the tapping point for a visual indication. The device only requires an electrical supply for the display unit and sensors.

Thus, forms of the present invention include a proximity switch attached externally adjacent each end of the cylinder. These proximity switches are connected to visual indicators (such as bright LED's of different colours). For example, the front cylinder proximity switch is connected to a red lamp and the rear to a green lamp. These visual indicators are mounted in an enclosure with a manual over ride push button. Power is fed to the enclosure which now powers up the visual indicators and proximity switches. An electrical connection is also made from this enclosure to a timer which controls the actuating solenoid valve controlling operation of the cylinder. Thus, when the piston and shaft inside the cylinder are fully retracted the magnet on the piston is influencing the proximity switch through the stainless steel cylinder wall of the cylinder, the proximity switch senses this magnetic field and illuminates a first visual indicator to show that the ram and clearing tool are retracted. After a pre-determined period, the timer will actuate the solenoid valve which channels compressed air into the rear chamber of the cylinder and exhausts the air out of the front chamber (for a double acting cylinder). The piston moves from the retracted position to the extended (advanced) position. Once the magnetic field (piston) moves away from the rear proximity switch the first visual indicator goes out. A short time later the piston arrives at the front of the cylinder when the clearing tool is fully advanced, and the front proximity switch senses the magnet and it illuminates the second visual indicator. This means that the retracted and extended positions are known, and if both visual indications are extinguished, it is possible to deduce it the piston, and hence the clearing tool, is mid stroke and remedial action needs to be taken.

A manual over ride control located on the enclosure allows an operator to activate (stroke) the clearing tool and ram outside the time constraints of the timer. For example, if the timer is set to actuate the solenoid valve every 4 hours and an operator wants to check the action of the clearing tool, then, rather than waiting 2, 3 or 4 hours to witness the next stroke, the timer can be overridden (without affecting it's settings) to operate the clearing tool.

Modifications and variations as would be apparent to a skilled addressee are deemed to be within the scope of the present invention.

The invention claimed is:

1. A process tapping point clearing apparatus including a ram housing a piston in a cylinder, the piston dividing the cylinder into first and second internal chambers, a shaft having a threaded first end adjacent an unthreaded intermediate portion of the shaft, the threaded first end threadingly engaged with a corresponding threaded portion of the piston, a second end of the shaft retaining a clearing head extending from the cylinder, the clearing head adapted to pass through a process tapping point for removing scaling and/or debris material therefrom; and wherein the threaded first end of the shaft has an outer thread diameter substantially the same as the diameter of the adjacent intermediate portion of the shaft and wherein the piston includes an aperture arranged to receive at least one retaining fastener, said at least one retaining fastener configured to engage with the threaded first end of the shaft within the piston and thereby prevent unthreading of the shaft from the piston until the retaining fastener is released from engagement with the threaded first end of the shaft.

2. The apparatus according to claim 1, wherein the thread of the threaded first end of the shaft extends to meet the shaft's outer surface at the adjacent intermediate portion, thereby ensuring maximum connection between the threaded first end and remaining shaft.

3. The apparatus according to claim 2, wherein the aperture arranged to receive the at least one retaining fastener extends from a side wall of the piston to the threaded portion engaging with the threaded first end of the shaft.

4. The apparatus according to claim 1, wherein the aperture arranged to receive the at least one retaining fastener extends from a side wall of the piston to the threaded portion engaging with the threaded first end of the shaft.

5. The apparatus according to claim 1, wherein said at least one retaining fastener includes a threaded portion to engage with a thread provided in the aperture.

6. The apparatus according to claim 5, wherein the aperture extends from an outer piston side surface adjacent an internal side wall of the cylinder to a threaded aperture extending into the piston from a first piston face adjacent the shaft, the threaded aperture arranged to receive the threaded first end of the shaft.

7. The apparatus according to claim 5, wherein the aperture extends from a portion of the piston open to a first face of the piston, and the retaining fastener extends through an internal central portion of the piston into a threaded aperture.

8. The apparatus according to claim 1, wherein the aperture extends from an outer piston side surface adjacent an internal side wall of the cylinder to the threaded portion of the piston extending as a threaded aperture into the piston from a first piston face adjacent the shaft, the threaded aperture arranged to receive the threaded first end of the shaft.

9. The apparatus according to claim 8, wherein the aperture extends from a portion of the piston open to a first face of the piston, and the retaining fastener extends through an internal central portion of the piston into a threaded aperture extending into a centre axis of the shaft.

10. The apparatus according to claim 1, wherein the threaded portion of the piston extends as a threaded aperture from a portion of the piston open to a first face of the piston, and the at least one retaining fastener extends through an internal central portion of the piston into the threaded portion of the piston.

11. The apparatus according to claim 1, said at least one retaining fastener including a grub or set screw.

12. The apparatus according to claim 1, wherein the shaft has an outer diameter of 10.0 mm, 12.0 mm or 16.0 mm and the threaded first end of the shaft has substantially the same matching outer diameter.

13. The apparatus according to claim 1, wherein the ram includes a selectively sealable aperture arranged to receive a retraction tool to, in use, retract the advanced piston and shaft, and thus the clearing head, from the process tapping point.

14. The apparatus according to claim 13, including the retraction tool having a shaft to be releasably engaged with the piston via an aperture into a second face of the piston.

15. The apparatus according to claim 14, wherein an aperture into the second face of the piston is threaded to releasably engage with a corresponding threaded end of the shaft of the retraction tool.

16. The apparatus according to claim 15, further including a sealable plug arrangement to releasably seal the aperture into the ram through which the retraction tool shaft is inserted to engage with the piston.

17. The apparatus according to claim 14, further including a sealable plug arrangement to releasably seal the aperture into the ram through which the retraction tool shaft is inserted to engage with the piston.

18. The apparatus according to claim 13, further including a sealable plug arrangement to releasably seal the aperture into the ram through which the retraction tool shaft is inserted to engage with the piston.

19. The apparatus according to claim 1 further including a position indication means having at least one sensor mounted externally of the cylinder, the at least one sensor arranged to detect respective advanced and retracted positions of the piston, and a position indication display means arranged to give a visual indication of detected advanced and retracted positions of the piston.

20. The apparatus according to claim 19, wherein the at least one sensor includes first and second sensors arranged in spaced relationship, the first sensor arranged to detect one of the advanced or retracted positions and the second position sensor arranged to detect the other of the advanced or retracted positions.

21. The apparatus according to claim 20, wherein an intermediate position of the piston between the advanced and retracted positions is indicated by a further indication.

22. The apparatus according to claim 20, further including a visual indication unit to display visually the indications of piston position.

23. The apparatus according to claim 19, wherein an intermediate position of the piston between the advanced and retracted positions is indicated by a further indication.

24. The apparatus according to claim 23, further including a visual indication unit to display visually the indications of piston position.

25. The apparatus according to claim 19, further including a visual indication unit to display visually the indications of piston position.

26. The apparatus according to claim 25, the visual indication unit being mounted on or adjacent the ram.

27. The apparatus according to claim 26, the visual indication unit including a test facility to cause the ram to actuate on demand and thereby demonstrate working of the ram by presence of the visual indications of the piston advanced and retracted positions.

28. The apparatus according to claim 25, the visual indication unit including a test facility to cause the ram to actuate on demand and thereby demonstrate working of the ram by presence of the visual indications of the piston advanced and retracted positions.

29. The apparatus according to claim 19, the at least one sensor including one or more induction sensors.

30. The apparatus according to claim 29, further including a magnetic material mounted to the piston and/or shaft within the ram and the magnetic material providing a magnetic field sensed by the at least one induction sensor to detect the position of the piston.

* * * * *